US006758628B1

(12) United States Patent
Curry, Jr.

(10) Patent No.: US 6,758,628 B1
(45) Date of Patent: Jul. 6, 2004

(54) METHOD AND APPARATUS FOR DEFLATING TIRES OF A TRAILING VEHICLE

(76) Inventor: Joseph Edward Curry, Jr., 21711 Roseville, Spring, TX (US) 77388

( * ) Notice: Subject to any disclaimer, the term of this patent is extended or adjusted under 35 U.S.C. 154(b) by 0 days.

(21) Appl. No.: 10/284,637

(22) Filed: Nov. 1, 2002

(51) Int. Cl.[7] ..... E01F 13/12
(52) U.S. Cl. ..... 404/6; 404/9
(58) Field of Search ..... 404/6, 9

(56) References Cited

U.S. PATENT DOCUMENTS

| | | | | | |
|---|---|---|---|---|---|
| 3,652,059 | A | | 3/1972 | Groblebe | 256/1 |
| 5,330,285 | A | | 7/1994 | Greves et al. | 404/6 |
| 5,452,962 | A | | 9/1995 | Greves | 404/6 |
| 5,482,397 | A | | 1/1996 | Soleau | 404/6 |
| 5,536,109 | A | | 7/1996 | Lowndes | 404/6 |
| 5,611,408 | A | | 3/1997 | Abukhader | 180/287 |
| 5,704,445 | A | | 1/1998 | Jones | 180/287 |
| 5,839,759 | A | * | 11/1998 | Trigo | 280/762 |
| 5,839,849 | A | | 11/1998 | Pacholok et al. | 404/6 |
| 5,871,300 | A | * | 2/1999 | Ingham | 404/6 |
| 5,890,832 | A | * | 4/1999 | Soleau | 404/6 |
| 5,921,704 | A | * | 7/1999 | Pacholok et al. | 404/6 |
| 6,048,128 | A | * | 4/2000 | Jones et al. | 404/6 |
| 6,312,189 | B1 | * | 11/2001 | Marphetia | 404/6 |
| 6,322,285 | B1 | * | 11/2001 | Ben | 404/6 |
| 6,409,418 | B1 | * | 6/2002 | Blair et al. | 404/6 |
| 6,474,903 | B1 | * | 11/2002 | Marts et al. | 404/6 |
| 6,527,475 | B1 | * | 3/2003 | Lowrie | 404/6 |
| 6,551,013 | B1 | * | 4/2003 | Blair | 404/6 |

FOREIGN PATENT DOCUMENTS

| | | | | | |
|---|---|---|---|---|---|
| FR | 2605655 | A | * | 4/1988 | E01F/13/00 |
| FR | 2714404 | A1 | * | 6/1995 | E01F/13/04 |
| GB | 2183702 | A | * | 6/1987 | E01F/13/00 |
| WO | WO 98/16689 | | | 4/1998 | |

* cited by examiner

*Primary Examiner*—Thomas B. Will
*Assistant Examiner*—Kristine Florio
(74) *Attorney, Agent, or Firm*—Russell J. Egan

(57) ABSTRACT

A device designed to be deployed from a leading vehicle to cause deflation of the tires of a trailing vehicle. The device has two primary components a deployable base member, with a plurality of tire piercing spikes extending therefrom, and a launch assembly designed to deposit the base member on a road surface in proper position to cause the deflation of the tires of a trailing vehicle.

18 Claims, 3 Drawing Sheets

METHOD AND APPARATUS FOR DEFLATING TIRES OF A TRAILING VEHICLE

BACKGROUND OF THE INVENTION

1. The Field of the Invention

The present invention relates to a tire deflating apparatus deployed from a vehicle and, in particular, to a device which is deployed from a leading vehicle and has a base member incorporating a plurality of spikes each having a metal sleeve loosely fitted thereon which penetrate and deflate the tires of a trailing vehicle.

2. The Prior Art

There seems to be an unfortunate increase in the instances of the police becoming involved in high speed chases of vehicles which have been involved in some sort of illegal activity. The chases are extremely dangerous and have resulted in a great many fatalities, usually of innocent parties A large number of schemes have been proposed for causing the deflation of the tires of the fleeing vehicle, many of these require depositing spiked strips ahead of the fleeing vehicle and then hoping that the driver of the fleeing vehicle will take a certain route leading to the spiked strips and will not take any evasive action-to avoid the spiked strips while on this route.

U.S. Pat. No. 5,839,849 to Pacholok et al discloses a device which is fired forward from a trailing vehicle. The device opens to deploy spikes against the tires of the lead vehicle. There would appear to be an inherent problem with this type of device. If there is a miss, then there is a substantial possibility causing damage to the trailing car's tires.

U.S. Pat. No. 5,704,445 to Jones discloses hollow spikes projecting from a base. This device is to be used with parked cars, placed by hand on either side of a tire of the car to be disabled, to prevent the car from being driven off.

U.S. Pat. No. 5,611,408 to Abukhader is somewhat similar to the above-mentioned Pacholok et al patent. It is distinguished by the fact that the spikes are hollow to assure deflation of the punctured tire. It would have the same difficulties as the Pacholok device.

U.S. Pat. No. 5,536,109 to Lowndes discloses a device to be deployed in advance of the car to be stopped. It combines spike strips, similar to those currently in use, with an apparatus to deploy the spiked strips, which have hollow spikes to increase the rate of deflation.

U.S. Pat. No. 5,482,397 to Soleau shows another type of device to be deployed ahead of the vehicle to be stopped. A plurality of hollow spikes project from a base and are torn off by the passing tire.

U.S. Pat. No. 5,452,962 to Greves discloses a special three piece spikes designed to penetrate a tire and leave a hollow quill embedded therein to deflate the tire.

U.S. Pat. No. 5,330,285 to Greves et al is similar to the above discussed patent.

U.S. Pat. No. 3,652,059 to Groblebe shows a sleeve disposed on a stud fixed to a base. The sleeve has a sharpened end which penetrates the tire and is retained therein.

WO 98/16689 discloses a device which is similar to those described in the Greves and Greves et al patents discussed above. Greves is a coinventor in the PCT patent.

SUMMARY OF THE INVENTION

The present invention is designed to be deployed from a leading vehicle to cause deflation of the tires of a trailing vehicle. The subject invention has two primary components: a deployable base member, with a plurality of tire piercing spikes extending therefrom, and a launch assembly designed to deposit the base member on a road surface in proper position to cause the deflation of the tires of a trailing vehicle.

BRIEF DESCRIPTION OF THE DRAWINGS

The present invention will now be described, by way of example, with reference to the accompanying drawings, in which.

DETAILED DESCRIPTION OF THE INVENTION

The present invention is intended for use in deflating the tires of a fleeing vehicle, usually a vehicle involved in criminal activity provoking police action in attempting to apprehend the driver of the fleeing vehicle. The subject invention is mounted on a vehicle beneath and to the rear of the chassis, in the general area beneath the trunk. The subject invention should not adversely affect the road clearance of the vehicle nor should it project beyond the vehicle's rear bumper.

Figure 3:
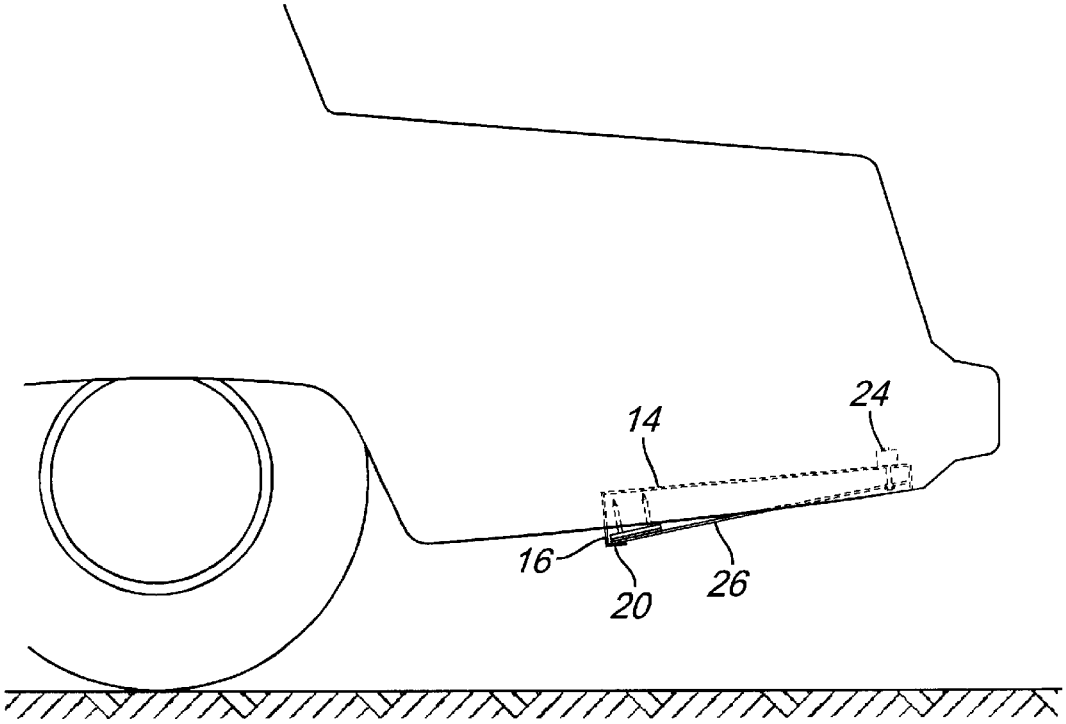
FIG. 3 is a diagrammatic side view of the subject invention mounted beneath the trunk portion of a police vehicle, with the subject invention in a stored and ready condition.
Figure 4:
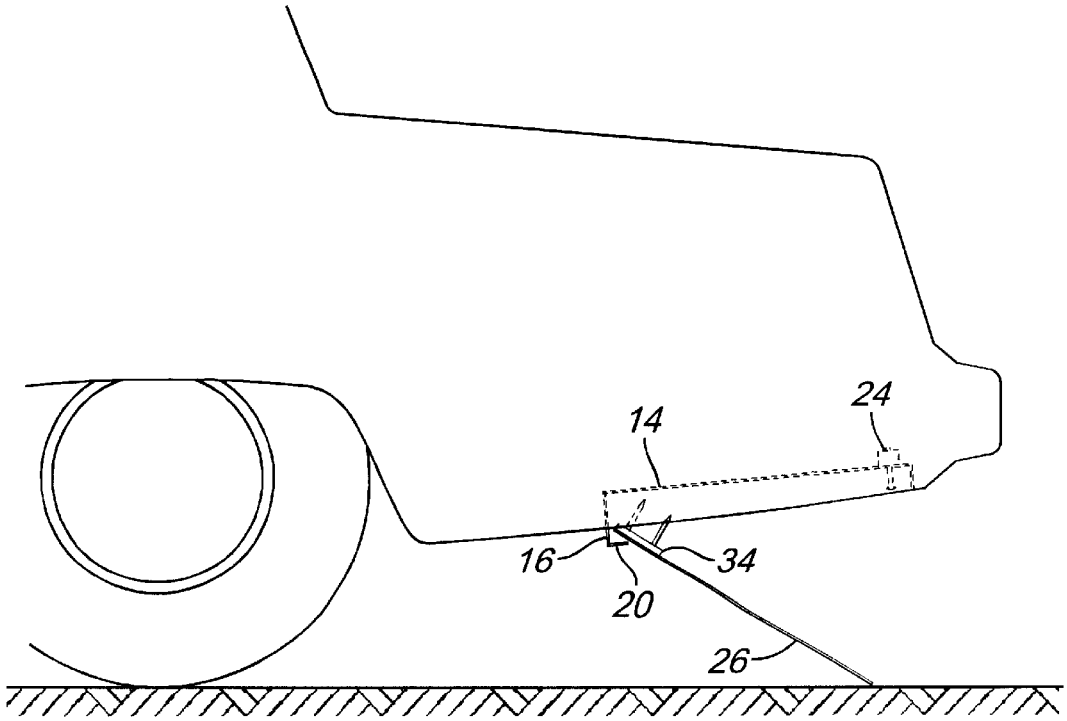
FIG. 4 is a diagrammatic side view, similar to FIG. 3, showing the subject invention in a deploying condition.

The subject invention has two main components, the housing assembly 10 and the tire deflating assembly 12. The housing assembly 10 is mounted on a vehicle, as shown in FIGS. 3 and 4. It has a generally rectangular upper plate 14 with a flange 16, depending from the leading edge 18 and ending in a rearwardly directed lip 20. The upper plate 14 may also have a downwardly depending trailing flange 22 and is provided with latching means 24. A generally rectangular lower plate 26 has its forward edge 28 received on the lip 20 and its rearward edge 30 is engaged by the latching means 24. The upper plate 14 and the lower plate 26 form a generally trapizodial compartment 32 in which a spiked strip 34 is positioned. The spiked strip 34 has a heavy base plate with a plurality of spikes 38 projecting therefrom Each spike 38 has a sleeve 40 mounted thereon.

As shown, the lower plate 26 has its leading edge resting on the lip 20 and is held in place both by the trailing edge engaging the flange 22 and the action of the latching means 24. The spiked strip 34, in this embodiment, is secured to the plate 26. To deploy the spiked strip 34, the latching means is actuated to release the trailing edge of plate 26. As this edge drops and engages the road surface, it causes the plate 26 to disengage from the lip 20 and drop to the road surface. The large area provided by the plate 24, as well as the weight of the spiked strip 34 base plate, will insure that the spikes will remain upright in proper position to engage the tires of the trailing vehicle.

Alternatively, the plate 26 could be hingedly attached to the lip 20 and the spiked strip 34 not attached to the plate 26 but allowed to slide down the plate 26, which would serve as a launching ramp.

Figure 1:
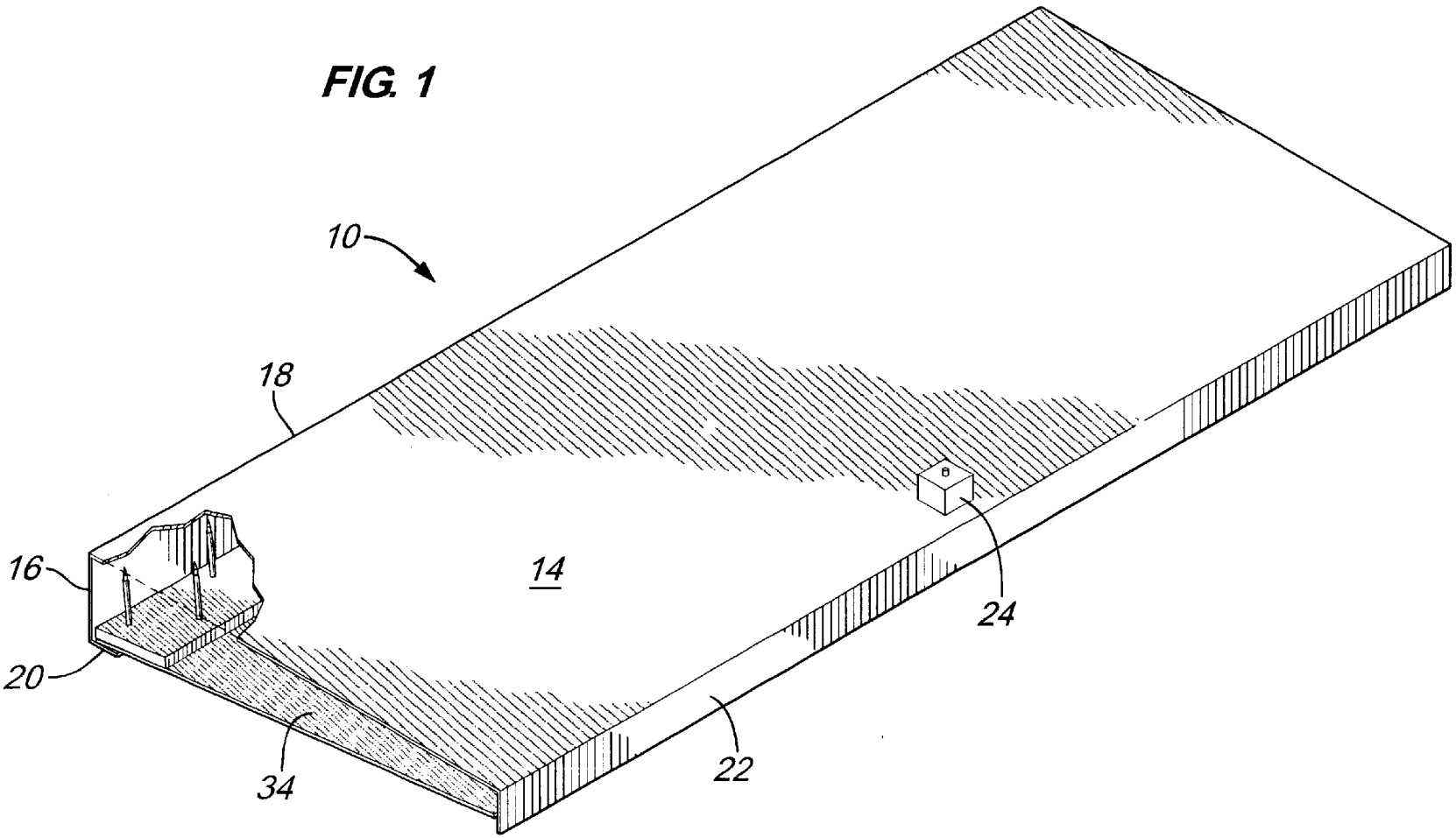
FIG. 1 is a perspective view, partially broken away, of the subject invention in a closed condition.
Figure 2:
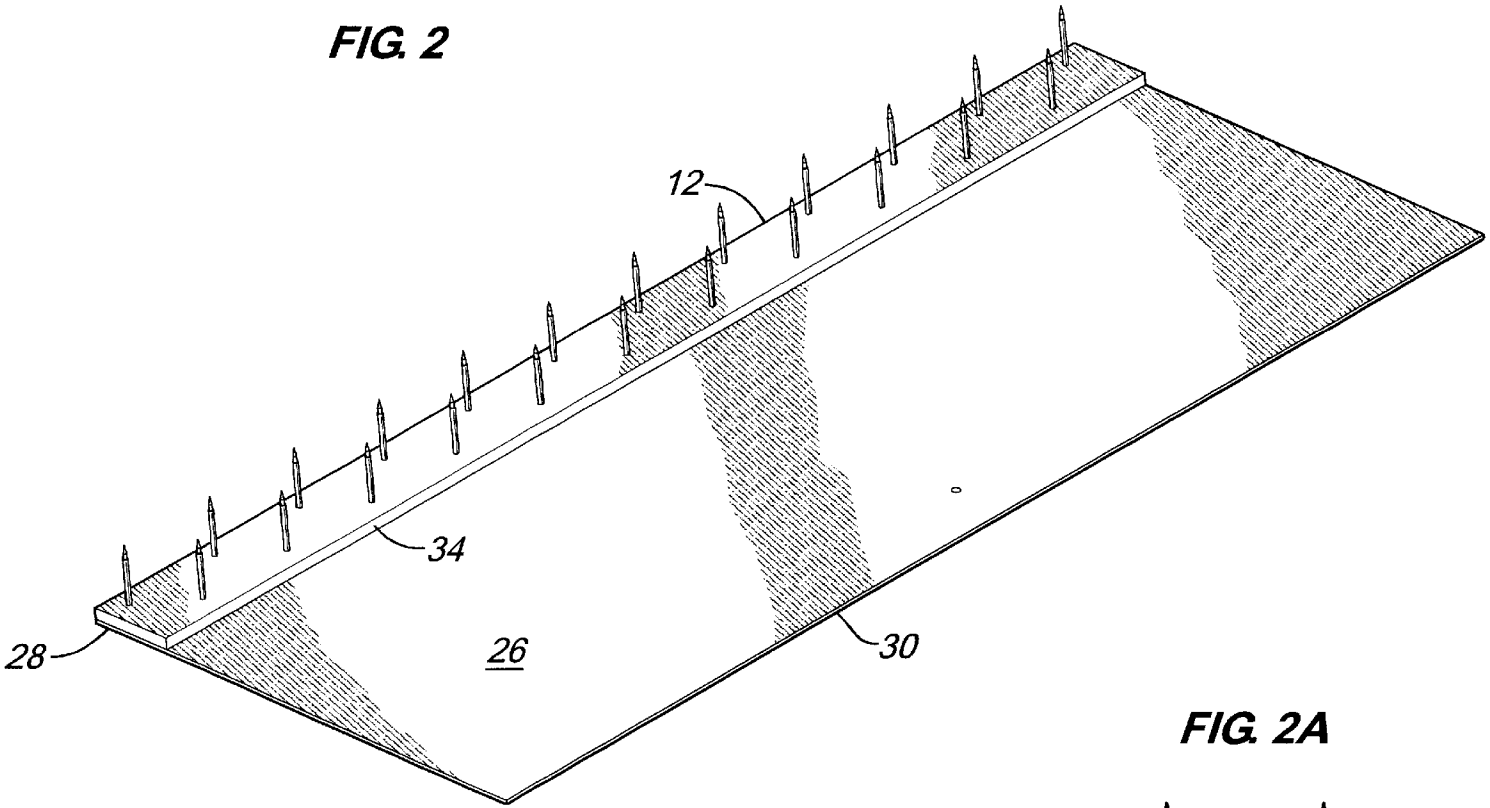
FIG. 2 is a perspective view of the spike strip and lower plate of the subject invention.
Figure 2A:
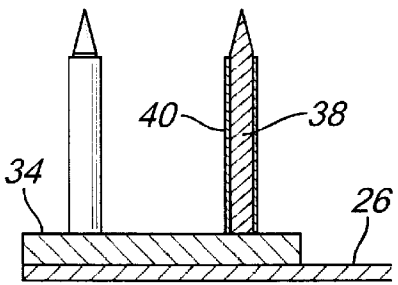
FIG. 2A is a detailed side elevation showing the spikes and sleeves of the subject invention, one sleeve being shown in section.

A typical spike 38 is shown in detail in FIG. 2A. The spike 38 has a first end 42 fixed to the base plate of the spiked strip 34 and a second sharpened end 44 projecting upwardly therefrom. A sleeve 40 pulling it from the spike 38 and provide means for rapidly deflating the tire. As an alternative, the spikes could be pivotally mounted and spring loaded to achieve a thinner overall housing design. As a further alternative, the spiked strip could include remote control means to deploy and retract the spikes.

The latching means 24 may be selected from any number of mechanical and/or electro mechanical latching devices. For example, there are many known latching devices currently available in the auto industry used for trunk releases, gas cap access releases, and hood releases. It may be preferred to have a totally mechanical release to avoid the unintended deploying of the spiked strip.

The spiked strip may be fixed to the lower plate so that, when deployed, there is no possibility of the spiked strip turning turtle to an ineffective position.

The trailing edge of the lower plate may also be profiled to present less surface area and therefor be more suitable for use on rough surfaces, including off-road conditions.

The present invention may be subject to many modifications and changes without departing from the spirit or essential characteristics thereof The present embodiment should therefor be considered in all respects as illustrative and not restrictive of the scope to the invention as defined by the appended claims.

I claim:

1. An apparatus mounted on a leading vehicle to cause deflation of the tires of a trailing vehicle, comprising:

a housing assembly mounted on a lower rear portion of said leading vehicle and defining a cavity therein, a bottom plate of said housing being releasable from the rest of the housing;

release means;

spiked strip means having a base member with a plurality of tire piercing spikes extending therefrom, each said spike having a removable sleeve mounted thereon, whereby when said bottom plate is released from said housing said spiked strip is deposited on a road surface substantially immediately in front of said trailing vehicle.

2. An apparatus according to claim 1 wherein said housing comprises;

an upper plate mounted to a lower rear portion of said lead vehicle;

a first flange depending from a leading edge of said plate and terminating in a rearwardly directed lip;

a second flange depending from a rear edge of said upper plate;

said bottom plate has a leading edge resting on said lip and a trailing edge held against said second flange by said release means.

3. An apparatus according to claim 1 wherein said release mechanism is electro-mechanical.

4. An apparatus according to claim 1 wherein said release means is mechanical.

5. An apparatus according to claim 1 wherein said spiked strip is secured to said bottom plate.

6. An apparatus according to claim 1 wherein said spiked strip comprises:

an elongated heavy base member;

a plurality of spikes fixed to and projecting from one side of said base member, said spikes being arranged in at least two off set rows, each said spike having a tubular sleeve removably mounted thereon whereby, when said spike pierces a tire, said tubular sleeve penetrates and is retained in said tire allowing the free flow of air therefrom.

7. A method to cause the deflation of the tires of a trailing vehicle from a leading vehicle comprising the steps of:

providing said lead vehicle with a housing assembly to be mounted beneath the rear portion of a vehicle, said housing having a releasable bottom plate;

providing a spiked strip on said bottom plate enclosed by said housing assembly;

providing release means for said bottom plate;

driving said leading vehicle to a position closely in front of said trailing vehicle;

opening bottom plate of said housing assembly to deposit said spiked strip on the road surface substantially immediately in front of said trailing vehicle whereby said spiked strip causes the deflation of the tires of a trailing vehicle.

8. A method according to claim 7 wherein said housing assembly comprises;

an upper plate mounted to a lower rear portion of said lead vehicle;

a first flange depending from a leading edge of said plate and terminating in a rearwardly directed lip;

a second flange depending from a rear edge of said upper plate;

said bottom plate has a leading edge resting on said lip and a trailing edge held against said second flange by said release means.

9. A method according to claim 8 wherein said release mechanism is electro-mechanical.

10. A method according to claim 8 wherein said release means is mechanical.

11. A method according to claim 8 wherein said spiked strip is secured to said bottom plate.

12. A method according to claim 8 wherein said spiked strip comprises:

an elongated heavy base member;

a plurality of spikes fixed to and projecting from one side of said base member, said spikes being arranged in at least one row, each said spike having a tubular sleeve removably mounted thereon whereby, when said spike pierces a tire, said tubular sleeve penetrates and is retained in said tire allowing the free flow of air therefrom.

13. A device for deflating the tires of a trailing vehicle from a lead vehicle, comprising:

housing means mounted on said lead vehicle and defining a cavity, said housing means having a releasable bottom plate and release means;

spiked strip means contained within said housing; and means to deposit said spiked strip from said housing into the path of said trailing vehicle.

14. A device apparatus according to claim 13 wherein said housing comprises;

a upper plate mounted to a lower rear portion of said lead vehicle;

a first flange depending from a leading edge of said plate and terminating in a rearwardly directed lip;

a second flange depending from a rear edge of said upper plate;

said bottom plate has a leading edge resting on said lip and a trailing edge held against said second flange by said release means.

15. A device according to claim 13 wherein said release mechanism is electro-mechanical.

16. A device according to claim 13 wherein said release means is mechanical.

17. A device according to claim 13 wherein said spiked strip is secured to said bottom plate.

18. A device according to claim 13 wherein said spiked strip comprises:

an elongated heavy base member;

a plurality of spikes fixed to and projecting from one side of said elongated heavy base member, said spikes being arranged in at least two off set rows, each said spike having a tubular sleeve removably mounted thereon whereby, when said spike pierces a tire, said tubular sleeve penetrates and is retained in said tire allowing the free flow of air therefrom.

* * * * *